US008293665B2

(12) United States Patent
Hartert et al.

(10) Patent No.: US 8,293,665 B2
(45) Date of Patent: Oct. 23, 2012

(54) ANTIBALLISTIC ARTICLE

(75) Inventors: Rudiger Hartert, Wuppertal (DE); Christian Bottger, Remscheid (DE)

(73) Assignee: Teijin Aramid GmbH, Wuppertal (DE)

( * ) Notice: Subject to any disclaimer, the term of this patent is extended or adjusted under 35 U.S.C. 154(b) by 835 days.

(21) Appl. No.: 12/453,434

(22) Filed: May 11, 2009

(65) Prior Publication Data

US 2009/0291280 A1 Nov. 26, 2009

Related U.S. Application Data

(60) Provisional application No. 61/129,124, filed on Jun. 5, 2008.

(30) Foreign Application Priority Data

May 26, 2008 (EP) ..... 08156909

(51) Int. Cl.
*D03D 13/00* (2006.01)

(52) U.S. Cl. ..... 442/203; 442/239; 442/246; 442/255

(58) Field of Classification Search ..... 442/203, 442/239, 246, 255
See application file for complete search history.

(56) References Cited

U.S. PATENT DOCUMENTS 3,771,418 A 11/1973 Gulbierz et al.
4,818,318 A * 4/1989 McMahon et al. ..... 156/166
4,883,700 A * 11/1989 Harpell et al. ..... 428/113
5,100,713 A 3/1992 Homma et al.
5,565,264 A 10/1996 Howland
5,668,344 A 9/1997 Bornstein
5,903,920 A 5/1999 Granqvist
6,103,646 A 8/2000 Chiou
6,127,291 A 10/2000 Coppage et al.
6,133,169 A 10/2000 Chiou et al.
6,147,018 A 11/2000 Chiou
6,151,710 A 11/2000 Bachner
6,227,257 B1 5/2001 Griffiths
6,266,819 B1 7/2001 Bachner
6,370,690 B1 4/2002 Neal
6,526,862 B1 3/2003 Lyons
6,651,543 B2 11/2003 Park
6,662,369 B2 12/2003 Fuchs et al.
6,705,197 B1 3/2004 Neal
(Continued)

FOREIGN PATENT DOCUMENTS

JP A-61-275440 12/1986
(Continued)

OTHER PUBLICATIONS

International Preliminary Report on Patentability for International Application No. PCT/EP2009/056115 mailed Dec. 16, 2010.
(Continued)

*Primary Examiner* — Andrew Piziali
(74) *Attorney, Agent, or Firm* — Oliff & Berridge, PLC

(57) ABSTRACT

An antiballistic article comprising a plurality of fabric layers of fibers with a strength of at least 1100 MPa according to ASTM D-885 is proposed, whereby there are at least two groups of areas with different textile densities within at least one fabric layer. Areas of a first group have a textile density of 8% to 31% according to Walz and areas of a second group have a textile density of 32% to 80% according to Walz.

22 Claims, 1 Drawing Sheet

U.S. PATENT DOCUMENTS

| | | | |
|---|---|---|---|
| 6,737,368 | B2 | 5/2004 | Chiou |
| 6,890,871 | B2 | 5/2005 | Bottger et al. |
| 6,911,247 | B2 | 6/2005 | Howland |
| 7,132,380 | B2 | 11/2006 | Bottger et al. |
| 7,150,046 | B2 | 12/2006 | Bottger et al. |
| 7,153,790 | B2 | 12/2006 | Bottger et al. |
| 2001/0031593 | A1 | 10/2001 | Fuchs et al. |
| 2003/0022583 | A1 | 1/2003 | Thomas et al. |
| 2003/0109188 | A1 | 6/2003 | Hartert et al. |
| 2003/0129900 | A1 | 7/2003 | Chiou |
| 2005/0066400 | A1 | 3/2005 | Bottger et al. |
| 2006/0037121 | A1 | 2/2006 | Park |
| 2007/0105468 | A1 | 5/2007 | Chiou et al. |
| 2007/0232173 | A1 | 10/2007 | Bain |
| 2008/0104735 | A1 | 5/2008 | Howland |
| 2009/0288235 | A1 | 11/2009 | Hartert et al. |

FOREIGN PATENT DOCUMENTS

| | | |
|---|---|---|
| WO | WO 02/14588 A1 | 2/2002 |

OTHER PUBLICATIONS

International Preliminary Report on Patentability for International Application No. PCT/EP2009/056116 mailed Dec. 16, 2010.

Notice of Allowance in U.S. Appl. No. 12/453,428 mailed Dec. 17, 2010.

New U.S. Application filed on May 11, 2009 in the name of Rudiger Hartert et al. that claims priority to U.S. Appl. No. 61/129,085, filed Jun. 4, 2008.

Co-pending U.S. Appl. No. 12/453,428, filed May 11, 2009.

* cited by examiner

ANTIBALLISTIC ARTICLE

CROSS REFERENCE

This nonprovisional application claims the benefit of U.S. Provisional Application No. 61/129,124, filed Jun. 5, 2008, and European Patent Application 08156909.7, filed May 26, 2008, which are incorporated herein by reference in their entirety.

BACKGROUND

The present disclosure relates to an antiballistic article comprising layers of fabric made of yarns of fibers with a strength of at least 1100 MPa according to ASTM D-885.

Antiballistic articles comprising layers of fabric are known in general. The document JP 612 75 440 A discloses a bulletproof vest comprising layers of fabric, with the yarns woven in a satin weave. In contrast with yarns woven in a linen weave, for example, yarns woven in a satin weave are not secured as well within the fabric layer. Therefore, according to the document JP 612 75 440 A, energy absorption when the vest is fired on is improved in comparison with energy absorption by a vest having layers of fabric woven in a linen weave. However, one disadvantage of fabric layers having a satin weave is their poor handleability. For example, it is very complicated to cut such fabric layers and stack them one above the other in manufacturing a penetration-inhibiting object.

The document WO 02/14588 A1 discloses the use of laminated fabric layers for bulletproof objects, whereby the fabric layers have a satin weave. However, a disadvantage of using laminated fabric layers having a satin weave is that the ability of the open satin weave to absorb energy is lost due to the lamination.

Another disadvantage is that fabric layers in a satin weave show a high trauma when fired on. Satin weaves in antiballistic fabrics thus have poor trauma values in addition to poor handleability of the fabric layers.

SUMMARY

One object of the present disclosure is to make available an antiballistic article of the type defined in the introduction which will at least avoid the disadvantages of the known art and with which good antiballistic properties can nevertheless be achieved.

This object is achieved with an antiballistic article comprising a plurality of fabric layers made of yarns of fibers having a strength of at least 1100 MPa according to ASTM D-885, whereby there are at least two groups of areas having different textile densities within at least one individual fabric layer, the areas of a first group having a textile density of 8% to 31% according to Walz and the areas of a second group having a textile density of 32% to 80% according to Walz.

DETAILED DESCRIPTION

Figure 1:
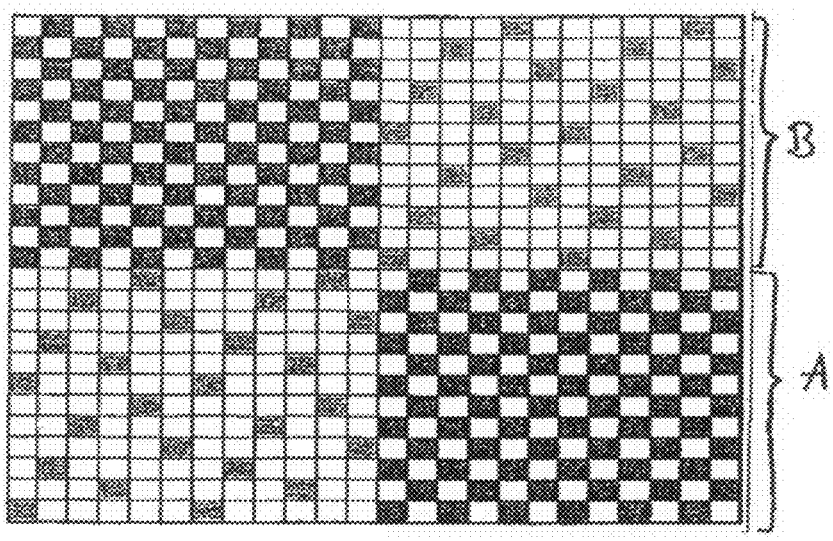
FIG. 1 shows schematically the weave design of a fabric layer to form the inventive antiballistic article.

The textile density according to Walz is determined by the following formula:

$$DG=(d_k+d_s)^2\times f_k\times f_s$$

wherein:

$d_k$=substance diameter of the warp yarn in mm;

$d_s$=substance diameter of the weft yarn in mm;

$f_k$=warp fibers per cm;

$f_s$=weft fibers per cm.

The substance diameter $d_k$ and/or $d_s$ of the yarns is calculated as follows:

$$d=\frac{\sqrt{\text{titer}}}{88.5\times\sqrt{\text{density}}}$$

where d denotes either $d_k$ or $d_s$ and the titer of the corresponding yarn in dtex and the density of the yarn in g/cm$^3$ are used.

The textile density calculated according to the formula applies to fabrics woven in linen weave. If the weave deviates from linen weave, a weave correction factor must be included in the calculation. For fabrics with special types of weaves, the following values are used for this weave correction factor, for example:

| | |
|---|---|
| Panama weaves 2:2 | 0.56 |
| Twill weaves 2:1 | 0.70 |
| Twill weaves 2:2 | 0.56 |
| Twill weaves 3:1 | 0.56 |
| Twill weaves 4:4 | 0.38 |
| Satin weave 1:4 | 0.49 |
| Satin weave 1:5 | 0.44 |

Textile density according to Walz DG is multiplied times these correction factors. The textile density is given in %.

The areas of the first group preferably have a textile density of from 8% to 25% according to Walz, such as from 8% to 20%, and the ranges of the second group may have a textile density of 32% to 70% according to Walz, such as from 32% to 50%. It is thus advantageously possible to utilize the advantages of high textile densities or low textile densities in a very specific manner in cases where they are needed within a fabric layer. For example, the edge areas of a fabric layer with a comparatively higher textile density may be formed in comparison with areas in the center of the fabric layer.

In embodiments, the areas of the first group have a first type of weave and the areas of the second group may have a second type of weave. The first type of weave may be different from the second type of weave. Thus, the different textile densities of the areas of the first group in comparison with the areas of the second group can be achieved in an advantageous manner through the different types of weave within the areas of the first group in comparison with the areas of the second group. Thus, in an advantageous manner—e.g., despite the use of yarns having the same yarn titers in the two areas—different textile densities can be created.

The areas of the first group may have a satin weave as the first type of weave. The satin weave may be a 1/5 or 1/4 satin weave.

In addition, the areas of the second group may have a 1/1 linen weave or twill weave. If the satin weave in the areas of the first group is a 1/5 weave, then the twill weave may be a 2/1 weave. If a 1/4 satin weave is used in the areas of the first group, then the areas of the second group may have a 2/3 or 1/4 twill weave or a 1/1 linen weave.

In further embodiments, the yarns of the areas of the first group have a first yarn titer and the areas of the second group have a second yarn titer. The first yarn titer may be different from the second yarn titer. However, the first yarn titer may correspond essentially to the second yarn titer. When using different yarn titers within the areas of the first group in comparison with the areas of the second group, a difference in textile density between the areas of the first group and the areas of the second group may be achieved, even if the same type of weave is used in the areas of the first group and the areas of the second group. The first yarn titer and the second yarn titer may be in the range of 100 dtex to 8000 dtex. However, if the two areas have different types of weaves, then a difference in textile density achieved in this way can be further increased advantageously by using different yarn titers in the different areas.

The areas of the first group may have a yarn titer of 100 dtex to 1000 dtex and the areas of the second group may have a yarn titer of 1050 dtex to 8000 dtex.

The fabric layer may have a first fiber count in the areas of the first group and a second fiber count in the areas of the second group. The first fiber count and the second fiber count may be the same or different and may be in the range of 2 threads/cm to 50 threads/cm. The fabric layer in the areas of the first group may have has a first thread count of 2 threads/cm to 10 threads/cm and in the areas of the second group may have a thread count of 10.1 threads/cm to 50 threads/cm.

The textile densities according to Walz in the areas of the first group and the areas of the second group may be influenced by such factors as, for example, the type of weave, the yarn type/titer and the thread count. If the areas of the first group differ from the areas of the second group by only one of these factors, then a different textile density according to Walz can be achieved between the areas of the first group and the areas of the second group. The areas of the first group and the areas of the second group may also differ with regard to two or more factors or all factors.

In general, the fabric layers and/or one fabric layer to form the article described herein may have yarns with a yarn titer of approximately 100 dtex to approximately 8000 dtex, regardless of the weaves or thread counts prevailing in the areas of the first group and the areas of the second group. In addition, the fabric layers and/or one fabric layer for forming the article described herein may have a thread count of two threads/cm to fifty threads/cm, regardless of the prevailing weaves or yarn titers in the areas of the first group and the areas of the second group. The fabric layers may of course have a linen weave or a twill weave or a satin weave in the areas of the first group and in the areas of the second group, regardless of the prevailing thread counts or yarn titers, to form the article described herein.

The areas of the second group may form a percentage area of at least 20% to 80% of the total area of the fabric layer, such as from 30% to 60% or from 40% to 50% of the total area of the fabric layer. The areas of the second group may also not be designed to be cohesive within the fabric layer. Instead, it is desired for the fabric layer to have a plurality of areas of the second group, whereby the areas of the second group are separated from one another by a plurality of areas of the first group, for example. Nevertheless, there are points of contact among the areas of the second group. Consequently, there may be a plurality of noncohesive areas of the first group within one fabric layer. In addition, it is also possible for there to be more than two groups of areas having different textile densities according to Walz within the fabric layer. The areas of the first group and the areas of the second group, each may extend over at least one repeat of the selected weave.

A fabric layer of the article described herein may have a fiber extraction resistance of from 200% to 700% of the thread extraction resistance of a fabric having the same type of weave as the areas of the first group with the same yarn titer and the same thread count. In addition, the fabric layer may have a thread extraction resistance of from 20% to 70% of the thread extraction resistance of a fabric having the same type of weave as the areas of the second group with the same yarn titer and the same thread count. The properties of the fabric layer may thus be altered by the areas of the second group in an advantageous manner.

The areas of the first group and the areas of the second group may be arranged in a strip pattern or in a checkerboard pattern with respect to one another. Other patterns are of course also possible, such as a diamond pattern or a triangular pattern. In addition, it is also possible for areas of the first group or the second group to be situated primarily in the edge area of the fabric layer (like a window frame, for example) and for the areas of the other group to be situated in the central area of the fabric layer. In the case of two successive fabric layers of the antiballistic article, the successive fabric layers may have essentially the same or different constructions. In the case of a different construction, for example, a first fabric layer may have areas of the first group in the edge area and areas of the second group in the central area, whereas a second fabric layer may have areas of the second group in the edge area and areas of the first group in the central area.

The yarns to form the fabric layer of the antiballistic article may be aramid yarns or yarns of polyethylene with an ultra-high molecular weight or yarns of polypropylene with an ultra-high molecular weight or yarns of polybenzoxazole or polybenzothiazole. In embodiments, the yarns of fibers of poly(p-phenyleneterephthalamide), such as those distributed under the brand name TWARON® by the company Teijin Aramid GmbH may be used. It is of course also possible for different yarns which contribute to a partial variation in the textile density to be provided within one fabric layer.

The strength of the fibers of the yarns to form the fabric layers of the antiballistic article may be greater than 2000 MPa according to ASTM D-885.

The antiballistic article according to the embodiments may be used to manufacture protective clothing such as bullet-proof protective vests. The inventive article may of course also ensure protection against punctures through a corresponding design of the fabric layers.

FIG. 1 shows schematically a weave design of a fabric layer for manufacturing the article described herein. In areas A, the fabric layer has a linen weave 1/1 with a textile density according to Walz of 37%, for example. In areas B, the fabric layer has a satin weave 1/5 (consecutive numbers 2,2,3,4,4), whereby the textile density according to Walz may be 16%, for example. The areas B are thus areas of a first group and are situated in a checkerboard arrangement with areas A which are areas of a second group. The weave design illustrated in FIG. 1 has the fabric layers from which the package according to Example 1 is formed for the subsequent shooting tests.

Figure 2:
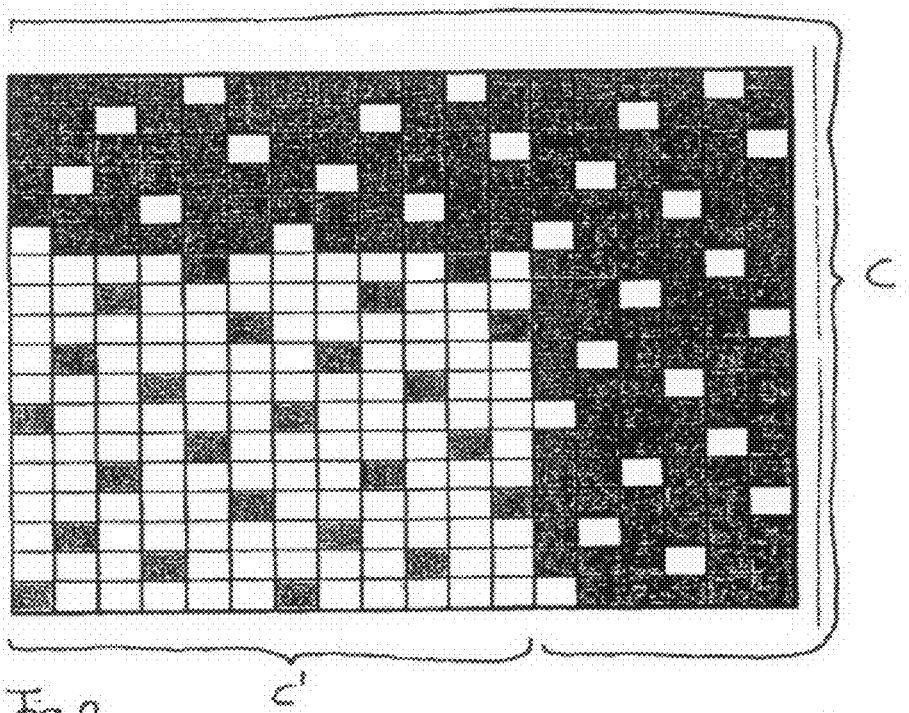
FIG. 2 shows schematically the weave design of a comparative fabric layer.

FIG. 2 shows schematically the weave design of a fabric of the same satin weave with a corresponding negative. In the areas C shown here, the fabric layer has a 5/1 satin weave (consecutive numbers 2,2,3,4,4), whereas areas C' have a 1/5 satin weave (consecutive numbers 2,2,3,4,4). Despite the different types of weave in areas C and C', the textile density according to Walz is 16% in the two areas, for example. In the exemplary embodiment in FIG. 2, the 1/5 satin weave (areas C') is shown with two repeats and the 5/1 satin weave (areas C) is shown with one repeat. The weave designs shown in FIG. 2 have the fabric layers of which the package according to Comparative Example 3 is produced for the following shooting test.

EXAMPLES

The yarns for production of the fabric layers in the example and in the comparative examples are aramid filament yarns with a strength of 3384 MPa according to ASTM-D885 and an effective titer of 960 dtex, which are sold by Teijin Aramid GmbH under the brand name TWARON® 930 dtex f1000. The aramid filament yarns have a density of 1.44 g/cm$^3$.

A plurality of packages, each formed from a plurality of fabric layers is tested.

Comparative Example 1

The article—and/or the package—according to Comparative Example 1 consists of 26 successive fabric layers, each fabric layer having a 1/1 linen weave and a thread count (TC) of 10.5/cm×10.5/cm. The textile density according to Walz is 37% for each of these fabric layers.

Comparative Example 2

The package according to Comparative Example 2 is also formed from 26 fabric layers, but each fabric layer has a 1/5 satin weave (consecutive numbers 2,2,3,4,4). The thread count is 10.5/cm$^1$×10.5/cm. The textile density according to Walz is 16% for each of these fabric layers.

Example 1

The article according to Example 1 consists of 26 fabric layers with two groups of areas having different textile densities. Each fabric layer to form the article has as areas of the first group areas with a 1/5 satin weave (consecutive numbers 2,2,3,4,4) and a thread count of 10.5/cm×10.5/cm. The textile density according to Walz amounts to 16% for the areas of this first group. The areas of a second group are formed by areas within the fabric layer with a 1/1 linen weave and a thread count of 10.5/cm×10.5/cm. The textile density according to Walz is 37% for the areas of this second group. The ratio between the areas in the linen weave and the areas in the satin weave is 1:1, whereby there are two repeats in satin weave in warp and weft directions and six repeats in linen weave in warp and weft directions. The textile density according to Walz was calculated as follows according to the formula given above:

$$DG_{[second\ group\ 1/1\ linen;\ 960\ dtex;\ 10.5\times10.5/cm]}=37\%$$

$$DG_{[first\ group\ 1/5\ satin;\ 960\ dtex;\ 10.5\times10.5/cm]}=37\%\times0.44$$

[correction factor]=16%

The fabric layers of the article are produced by feeding in thread groups as shaft goods on a gripper weaving machine with a dobby loom. Six shafts are required for feeding the yarns for production of the areas in linen weave and six shafts are required for feeding the yarns for production of the areas in satin weave.

Comparative Example 3

The package according to the Comparative Example 3 has 26 fabric layers. The fabric layers are produced with the method described for Example 1 in such a way that each fabric layer has two different weaves. The textile density according to Walz, however, is the same within the fabric layer despite different weaves. The weaves used include a 1/5 satin weave (consecutive numbers 2,2,3,4,4) and a 5/1 satin weave (consecutive numbers 2,2,3,4,4) with a textile density according to Walz of 16% in all areas.

The extraction resistance is determined on the fabric layers that are used to form the articles of Comparative Examples 1 to 3 and Example 1. To do so, five strips each in the warp and weft directions are prepared from one fabric layer. The length of the strips is 30 cm, and the width is from 6 to 8 cm, depending upon the type of fabric. Each of the strips is gathered to a fabric width of 5 cm. The thread to be tested is situated in the center of the fabric strip and is thus removed from the fabric for 10 cm on the top side of the strip and/or on the bottom side of the strip, so that 10 cm of this thread remains in the fabric composite. The thread removed is then cut to a 1 cm free length on the underside of the strip. The fabric strip is then clamped at the bottom in a fabric clamp in such a manner that the thread that was previously removed and cut remains free. The thread that is exposed at the top is clamped in a yarn clamp with the least possible tension. The maximum force in Newtons, which is needed to extract the thread out of the 10-cm-long fabric composite, is measured. The extraction resistance is understood to be the arithmetic mean of the total of ten test values measured. The thread extraction velocity is 50 mm/min.

The results of the measurements of the extraction resistance are summarized in Table 1.

TABLE 1

| | Comparative Example 1 | Comparative Example 2 | Example 1 | Comparative Example 3 |
|---|---|---|---|---|
| Extraction resistance (N) | 313.5 | 28.8 | 109 | 14.3 |

The extraction resistance of a fabric with a textile density of 37% (Comparative Example 1) determined by the method described above is thus greater by a factor of 10 than the extraction resistance of a fabric with a textile density of 16% (Comparative Example 2). Although the textile density according to Walz for the fabric layers in Comparative Example 3 corresponds to the textile density according to Walz in Comparative Example 2, the extraction resistance in the fabric layer of Comparative Example 3 is approximately half as high due to the use of an alternating weave. The fabric layer to form the article according to Example 1 has an extraction resistance that is higher than the extraction resistance of a fabric having a lower textile density (Comparative Example 2) but is lower than the extraction resistance of a fabric having a higher textile density (Comparative Example 1). The use of different textile densities thus influences the different extraction resistances so that the extraction resistance—like the textile density—is a measure of the mobility of the fibers in the fabric layer.

With a thread extraction resistance of about 109 N, the fabric layer of the inventive article according to Example 1 has an extraction resistance amounting to 378% of the extraction resistance of the fabric according to Comparative Example 2, i.e., a fabric having the same type of weave with the same yarn titer and the same thread count as the areas of the first group, namely the areas in the 1/5 satin weave. With a thread extraction resistance of 109 N, the fabric layer of the inventive article has an extraction resistance which amounts to 35% of that of the fabric according to Comparative Example 1, i.e., a fabric which has the same type of weave with the same yarn titer and the same thread count as the areas of the second group, namely the areas in linen weave.

Comparison of the Ballistic Performance

Three packages per type of ammunition were tested for each of Comparative Examples 1 to 3 and Example 1, each package (~5.2 kg/m$^2$) having 26 fabric layers and the respective type of ammunition being fired on eight times from a distance of 10 meters to determine the $V_{50}$ value and the energy absorbed. The $V_{50}$ value means that there is a penetration probability of 50% at the stated velocity. A Weible plasticine block was arranged behind the packages. The energy absorption is calculated from $\frac{1}{2} mv^2$, where m is the weight in kg and v is the $V_{50}$ velocity in m/s.

In a second test to determine the background deformation (hereinafter referred to as trauma) a Weible plasticine block is used. It is known that the trauma can be measured by the bulge caused by the bullet on the side facing away from the threat (shooting side). To determine the trauma, each package was arranged in front of the Weible plasticine block and fired at eight times at an approximately constant velocity in the range of from 434 m/s to 443 m/s from a distance of five meters. Four shots were then aimed at the outer area of the packages and four shots were directed at the inner area of the packages. With the selected bullet velocities, there were no penetrating shots but instead only embedded bullets. The average trauma was calculated as the depth of penetration into the plasticine in mm from these eight shots for each design and each type of ammunition.

The respective averages of the results of the shooting tests are summarized in Tables 2 and 3.

Shooting Test 1

Fired on with 0.44 Magnum JHP Remington 15.6 g.

TABLE 2

| | $V_{50}$ (m/s) | Energy absorption (J) | Trauma (mm) |
|---|---|---|---|
| Comparative Example 1 | 488 | 1858 | 50 |
| Comparative Example 2 | 493 | 1896 | 59 |
| Comparative Example 3 | 492 | 1888 | 57 |
| Example 1 | 497 | 1927 | 54 |

As shown in Table 2, the package constructed according to Comparative Example 2 (satin weave) has a $V_{50}$ value of 493 m/s when fired on with 0.44 Magnum and an energy absorption of about 1896 J accordingly. However, the trauma when such a package is fired on amounts to 59 mm. However, the package from Comparative Example 1 (linen weave) has a $V_{50}$ of 488 m/s when fired on and an energy absorption of 1858 J. The trauma in this case is only 50 mm. Consequently, the open satin weave (Comparative Example 2) is characterized by a high energy absorption in comparison with the linen fabric (Comparative Example 1) but is greatly inferior to a linen fabric with regard to the trauma. The article (Example 1) has a $V_{50}$ value of 497 m/s, which corresponds to an energy absorption of 1927 J. The trauma for the package according to Example 1 is 54 mm. The article described herein even shows an increase in energy absorption in comparison with a package of only satin-weave layers in a result that is quite surprising for those skilled in the art and could not have been foreseen and thus constitutes an improvement in the antiballistic properties. In addition, the value for the trauma with the package according to Example 1 is slightly greater than the value for the trauma with a package according to Comparative Example 1, which was also completely surprising, but a definite improvement is achieved in comparison with the trauma with a package according to Comparative Example 2. In a comparison of the packages according to Comparative Example 3 and Example 1, it is also surprisingly found that the presence of different types of weaves within one fabric layer does not lead to an improvement in the energy absorption and trauma but instead there must also be different textile densities with the different types of weaves. In the combination of linen weave and satin weave within a fabric layer (Example 1), the good antiballistic property of a satin fabric has surprisingly been combined with the stability of a linen fabric. A fabric layer manufactured in this way has a better energy absorption when fired on in comparison with a pure linen fabric and had an improved trauma behavior and a definitely improved handleability in comparison with a pure satin fabric.

Shooting Test 2

Fired on 0.357 Magnum JSP Remington 10.2 g.

TABLE 3

| | $V_{50}$ (m/s) | Energy absorption (J) | Trauma (mm) |
|---|---|---|---|
| Comparative Example 1 | 505 | 1301 | 37 |
| Comparative Example 2 | 526 | 1411 | 46 |
| Example 1 | 513 | 1342 | 41 |

According to Table 3, the energy absorption of a package with only satin fabric layers (Comparative Example 2), when fired on with 0.357 Magnum, is slightly greater than the energy absorption of the inventive article (Example 1), but the trauma when using the article is definitely below the trauma which occurs with shooting a package having only satin fabric layers.

We claim:

1. An antiballistic article comprising:

a plurality of fabric layers of yarns of fibers with a strength of at least 1100 MPa according to ASTM D-885, wherein within at least one individual fabric layer there are at least two groups of areas having different textile densities, the areas of a first group of the at least two groups having a textile density according to Walz of 8% to 31% and the areas of a second group of the at least two groups having a textile density according to Walz of 32% to 80%, wherein the areas of the first group have a first type of weave and the areas of the second group have a second type of weave, and the first type of weave and second type of weave are different from one another.

2. The antiballistic article according to claim 1, wherein the areas of the first group have a textile density according to Walz of 8% to 25% and the areas of the second group have a textile density according to Walz of 32% to 70%.

3. The antiballistic article according to claim 1, wherein the areas of the first group have a textile density according to Walz of 8% to 20% and the areas of the second group have a textile density according to Walz of 32% to 50%.

4. The antiballistic article according to claim 1, wherein the first type of weave is a satin weave.

5. The antiballistic article according to claim 4, wherein the satin weave is a 1/5 or 1/4 weave.

6. The antiballistic article according to claim 1, wherein the second type of weave is a linen weave or a twill weave.

7. The antiballistic article according to claim 6, wherein the second type of weave is a twill weave and the twill weave is a 2/1 twill weave or a 1/4 twill weave and the linen weave is a 1/1 linen weave.

8. The antiballistic article according to claim 1, wherein the yarns of fibers of the areas of the first group of the at least two groups have a first yarn titer and the yarns of fibers of the areas of the second group of the at least two groups have a second yarn titer, the first and second yarn titers being different from one another within one fabric layer of the plurality of fabric layers.

9. The antiballistic article according to claim 1, wherein the yarns of fibers of the areas of the first group of the at least two groups have a first yarn titer and the yarns of the areas of the second group of the at least two groups have a second yarn titer, and the first yarn titer and the second yarn titer are the same as or different from one another within one fabric layer of the plurality of fabric layers.

10. The antiballistic article according to claim 8, wherein the first yarn titer and the second yarn titer are in the range of 100 dtex to 8000 dtex.

11. The antiballistic article according to claim 8, wherein the first yarn titer is 100 dtex to 1000 dtex and the second yarn titer is 1050 dtex to 8000 dtex.

12. The antiballistic article according to claim 1, wherein the areas of the first group of the at least two groups have a first thread count and the areas of the second group of the at least two groups have a second thread count, and the first thread count and the second thread count within one fabric layer of the plurality of fabric layers are different from one another.

13. The antiballistic article according to claim 12, wherein the first thread count and the second thread count are in a range of 2 threads/cm to 50 threads/cm.

14. Antiballistic article according to claim 12, wherein the areas of the first group of the at least two groups have a thread count of 2 threads/cm to 10 threads/cm and the areas of the second group of the at least two groups have a thread count of 10.1 threads/cm to 50 threads/cm.

15. The antiballistic article according to claim 1, wherein the areas of the second group of the at least two groups have a percentage area of from 20% to 80% of a total area of one fabric layer of the plurality of fabric layers.

16. The antiballistic article according to claim 1, wherein the plurality of fabric layers have a thread extraction resistance, of from 200% to 700% of a thread extraction resistance of a fabric that has a same type of weave with the same yarn titer and a same thread count as the areas of the first group of the at least two groups.

17. The antiballistic article according to claim 1, wherein the plurality of fabric layers have a thread extraction resistance of from 20% to 70% of a thread extraction resistance of a fabric that has a same type of weave with a same yarn titer and same thread count as the areas of the second group of the at least two groups.

18. The antiballistic article according to claim 1, wherein areas of the first group of the at least two groups and areas of the second group of the at least two groups are arranged in a checkerboard pattern with one another.

19. The antiballistic article according to claim 1, wherein areas of the first group of the at least two groups and areas of the second group of the at least two groups are arranged in a strip pattern relative to one another.

20. The antiballistic article according to claim 1, wherein the yarns of fibers comprise at least one of aramid yarns, polyethylene yarns with an ultra-high molecular weight, polypropylene with an ultra-high molecular weight, polybenzoxazole or polybenzothiazole.

21. The antiballistic article according to claim 1, wherein fibers of the yarns of fibers have a strength of greater than 2000 MPa according to ASTM-D885.

22. Protective clothing comprising the antiballistic article according to claim 1.

* * * * *